US009095770B2

(12) United States Patent
Ho et al.

(10) Patent No.: US 9,095,770 B2
(45) Date of Patent: Aug. 4, 2015

(54) LAUNCHING TOY GAME

(75) Inventors: Chun Kit Ho, Rosemead, CA (US); Nicole Ashley Jenkins, Simi Valley, CA (US); Erich William Weidetz, Santa Monica, CA (US)

(73) Assignee: Mattel, Inc., El Segundo, CA (US)

( * ) Notice: Subject to any disclaimer, the term of this patent is extended or adjusted under 35 U.S.C. 154(b) by 938 days.

(21) Appl. No.: 13/292,869

(22) Filed: Nov. 9, 2011

(65) Prior Publication Data

US 2012/0286475 A1 Nov. 15, 2012

Related U.S. Application Data

(60) Provisional application No. 61/412,963, filed on Nov. 12, 2010, provisional application No. 61/512,394, filed on Jul. 27, 2011.

(51) Int. Cl.

| | |
|---|---|
| ***A63F 9/02*** | (2006.01) |
| ***A63H 33/04*** | (2006.01) |
| ***A63F 9/26*** | (2006.01) |
| *A63F 1/04* | (2006.01) |

(52) U.S. Cl.

CPC ... *A63F 9/02* (2013.01); *A63F 9/26* (2013.01); *A63H 33/04* (2013.01); *A63F 2001/0475* (2013.01); *A63F 2009/0273* (2013.01)

(58) Field of Classification Search

CPC ..... A63F 9/02; A63F 9/26; A63F 9/0204; A63F 9/0243; A63F 9/0247; A63F 9/0252; A63F 2009/0256; A63F 2009/026; A63F 2009/0265; A63F 2009/0273; A63F 9/0278; A63F 2009/0282; A63F 1/00; A63F 1/04; A63F 2001/0475; A63H 33/00; A63H 33/04; A63H 33/06

USPC ..... 273/317, 348, 351, 441, 449, 459, 292, 273/380, 378, 405

See application file for complete search history.

(56) References Cited

U.S. PATENT DOCUMENTS

| | | | | | |
|---|---|---|---|---|---|
| 135,494 | A | | 2/1873 | Smith | |
| 138,038 | A | | 4/1873 | Morley | |
| 151,410 | A | | 5/1874 | Marshall | |
| 275,308 | A | | 4/1883 | Williams | |
| 284,965 | A | | 9/1883 | Ireland | |
| 674,848 | A | | 5/1901 | Stevens | |
| 971,470 | A | | 9/1910 | Peall | |
| 1,023,176 | A | | 4/1912 | Schuster | |
| 1,091,339 | A | | 3/1914 | Howarth | |
| 1,226,551 | A | | 5/1917 | MacPherson | |
| 1,402,637 | A | | 1/1922 | Miller | |
| 1,425,376 | A | | 8/1922 | Ford | |
| 1,454,982 | A | | 5/1923 | Pye | |
| 1,929,327 | A | | 10/1933 | Moray | |
| 2,473,091 | A | | 6/1949 | Brooks et al. | |
| 2,626,154 | A | | 1/1953 | Lowry | |
| 2,923,548 | A | * | 2/1960 | Kappel | 273/386 |
| 3,009,700 | A | * | 11/1961 | Dolega | 273/348 |
| 3,305,236 | A | | 2/1967 | Glass et al. | |
| 3,375,008 | A | | 3/1968 | Atkinson | |
| 3,398,956 | A | | 8/1968 | Lukes | |

(Continued)

*Primary Examiner* — Raleigh W Chiu

(74) *Attorney, Agent, or Firm* — Edell, Shapiro & Finnan, LLC

(57) ABSTRACT

A skills game includes a game set with a deck of cards, various-shaped building blocks, a projectile launcher, projectiles, and target pieces. Players take turns selecting a card, building structures, launching projectiles, and knocking down targets.

20 Claims, 7 Drawing Sheets

(56) References Cited

U.S. PATENT DOCUMENTS

| | | | | | |
|---|---|---|---|---|---|
| 3,495,828 | A | | 2/1970 | Reavis et al. | |
| 3,565,432 | A | | 2/1971 | Reiner et al. | |
| 3,582,075 | A | | 6/1971 | Glass et al. | |
| 3,610,623 | A | | 10/1971 | Ferrer | |
| 3,649,018 | A | | 3/1972 | Beam | |
| 3,669,451 | A | * | 6/1972 | Welbourn | 273/412 |
| 3,680,864 | A | | 8/1972 | Peterson | |
| 3,698,714 | A | | 10/1972 | Breslow | |
| 3,787,052 | A | | 1/1974 | Glass et al. | |
| 3,794,325 | A | | 2/1974 | Stender | |
| 3,811,675 | A | | 5/1974 | Torgow | |
| 3,857,562 | A | | 12/1974 | Rardon et al. | |
| 3,891,216 | A | | 6/1975 | Ensmann et al. | |
| 3,899,170 | A | | 8/1975 | Parks et al. | |
| 3,927,884 | A | | 12/1975 | Glass et al. | |
| 3,936,052 | A | | 2/1976 | Hornsby, Jr. | |
| 3,997,163 | A | | 12/1976 | Cooper et al. | |
| 4,009,879 | A | | 3/1977 | Wolf | |
| 4,039,188 | A | | 8/1977 | Goldfarb et al. | |
| 4,509,760 | A | | 4/1985 | Goldfarb et al. | |
| 4,583,743 | A | | 4/1986 | Macek | |
| 4,733,871 | A | | 3/1988 | McQueeny et al. | |
| 4,805,918 | A | * | 2/1989 | Feinberg | 273/380 |
| 4,961,584 | A | | 10/1990 | Day, Sr. | |
| 5,203,559 | A | | 4/1993 | Goldfarb | |
| 5,299,966 | A | | 4/1994 | Rose, III | |
| 5,409,224 | A | | 4/1995 | Schiess | |
| 5,772,204 | A | | 6/1998 | Phelps | |
| 5,879,005 | A | | 3/1999 | Baca | |
| 6,102,405 | A | * | 8/2000 | Spikes | 273/405 |
| 6,585,268 | B2 | | 7/2003 | Williams | |
| 6,634,954 | B1 | | 10/2003 | Diaw | |
| 7,052,013 | B2 | * | 5/2006 | Olsen | 273/450 |
| 7,063,324 | B2 | * | 6/2006 | Kelley et al. | 273/317 |
| 7,487,972 | B2 | * | 2/2009 | Halliburton | 273/458 |
| 8,128,092 | B2 | * | 3/2012 | Ritter | 273/292 |
| 8,444,151 | B2 | * | 5/2013 | Moran et al. | 273/450 |
| 2007/0284825 | A1 | | 12/2007 | Blagg et al. | |
| 2010/0181720 | A1 | | 7/2010 | Barthold et al. | |
| 2010/0237563 | A1 | * | 9/2010 | Belete et al. | 273/348 |
| 2012/0283051 | A1 | * | 11/2012 | Belete et al. | 473/473 |
| 2012/0286475 | A1 | * | 11/2012 | Ho et al. | 273/380 |

* cited by examiner

LAUNCHING TOY GAME

CROSS-REFERENCE TO RELATED APPLICATIONS

This application claims priority to and the benefit of U.S. provisional patent application No. 61/412,963, filed Nov. 12, 2010, entitled "Launching Toy Game", and U.S. provisional patent application No. 61/512,394, filed Jul. 27, 2011, entitled "Launching Toy Game," the contents of each of which is hereby incorporated by reference in full.

FIELD OF THE INVENTION

The disclosure relates generally to a skills game. More specifically, the skills game includes launching a toy projectile at a physical structure.

BACKGROUND

Skills games have been and continue to be an ample source of amusement for children. Enhancements, features, and themes that spark a child's imagination and provide continued engagement of the game with the child add to its play value.

One video game line made available for the IPHONE, IPAD and ANDROID mobile devices by the Finland-based developer ROVIO MOBILE LTD is entitled ANGRY BIRDS. As a player enters a level in the ANGRY BIRDS video game, the device displays a structure appearing to be made from various materials including wood, glass or ice and stone. Various-sized and -shaped green pigs appear within the structure. The structure scrolls off-screen and a slingshot with a queue of various-sized, -shaped, and -colored birds scrolls on-screen. The birds serve as projectiles for the slingshot to be launched against one side of the structure. The player launches each bird projectile by touching the mobile device screen with a finger, dragging the finger across the screen to simulate pulling back the projectile in the slingshot pocket, and lifting the finger from the screen to launch the projectile. Additional properties particular to each projectile may be activated by tapping the screen while the bird projectile is in flight. The goal is to knock over the green pigs, either by the projectile birds directly or with portions of the collapsing structure. A bonus area with golden eggs was made available in a later chapter release of the game. Golden eggs hidden throughout the game unlock other levels and features. In some versions of the game, images of wooden crates labeled with "TNT" are interspersed in the structure. When struck, the wooden crate explodes and destroys objects within a short radius and sends objects within a larger radius flying. While the game play of ANGRY BIRDS is fanciful and engaging, it is limited to a single-player virtual world with simulated physics. Furthermore, the ANGRY BIRDS video game lacks the excitement and challenge of a tangible skills game apparatus and methods associated therewith.

SUMMARY

The disclosure includes a skills game. The skills game includes a game set with a deck of cards, various-shaped building blocks, a projectile launcher, projectiles, and target pieces. Players take turns selecting a card, building structures, launching projectiles, and knocking down targets.

Other systems, methods, features and advantages will be, or will become, apparent to one with skill in the art upon examination of the following figures and detailed description.

All such additional systems, methods, features and advantages are included within this description, are within the scope of the claimed subject matter, and are protected by the following claims.

BRIEF DESCRIPTION OF THE DRAWINGS

The skills game may be better understood with reference to the following drawings and description. The elements in the figures are not necessarily to scale, emphasis instead being placed upon illustrating the principles of the skills game. In the figures, like-referenced numerals designate corresponding parts throughout the different views.

DETAILED DESCRIPTION

A skills game kit for a skills game may include a deck of cards printed with missions and structures, various-shaped building blocks from which the structures may be built, a projectile launcher, projectiles of various shapes and sizes, and target pieces of various shapes and sizes. Players take turns selecting a mission card, building structures based on illustrations printed on the card, launching projectiles at the completed structures, and knocking down target pieces. The skills game may enhance spatial-recognition ability, construction skills, manual dexterity, peer-to-peer interactivity, and hand-eye coordination in a fun and entertaining environment.

Figure 1:
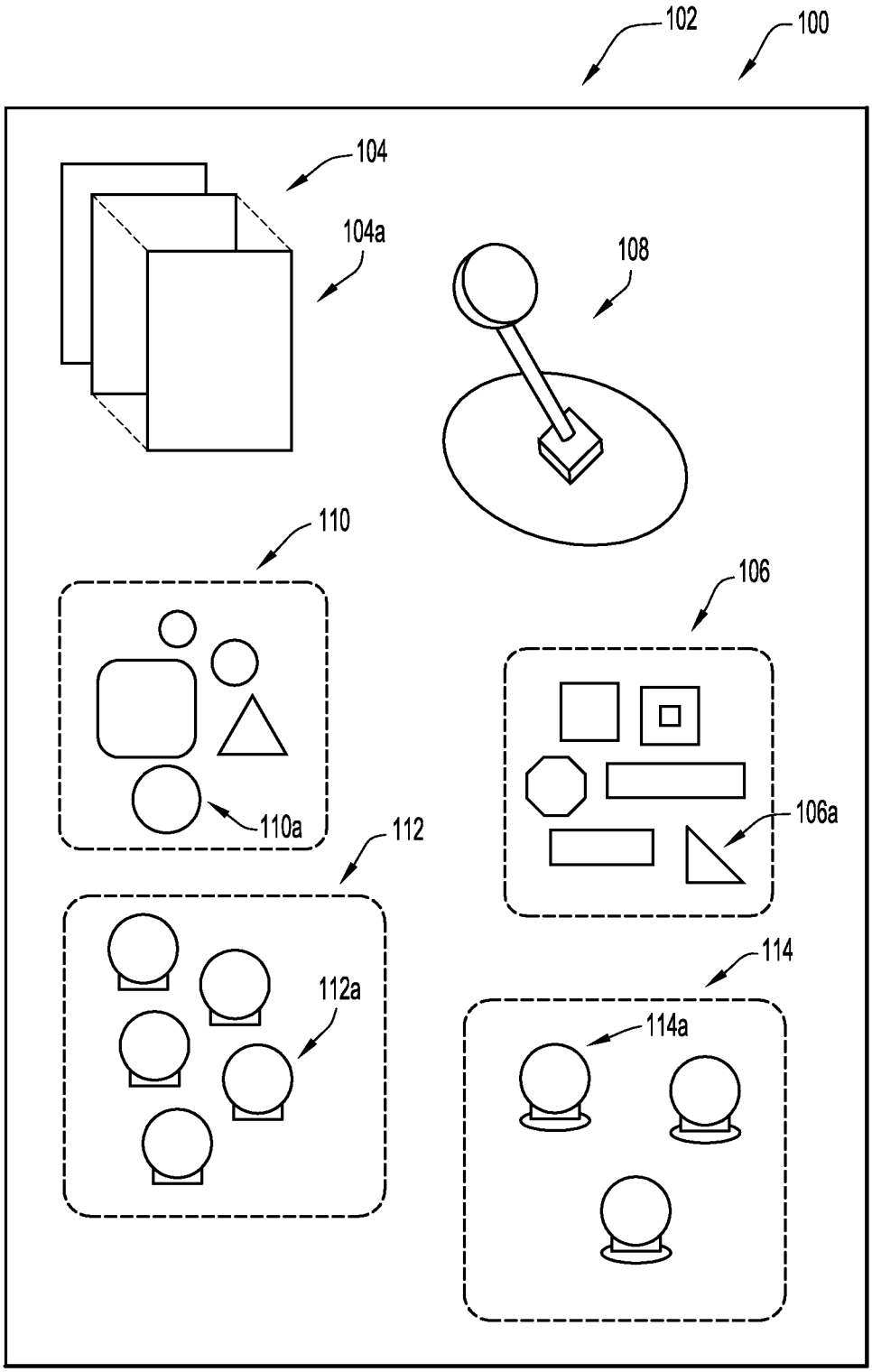
FIG. 1 is an illustration of an embodiment of a skills game kit.

FIG. 1 is an illustration 100 of an embodiment of a skills game kit 102. The skills game kit 102 may be contained in a single package or may be a collection of loose components. The skills game kit 102 may be used to carry out a method of game play. In one embodiment and for illustrative purposes throughout this disclosure, the skills game kit 102 includes a deck of cards 104 including a card 104*a*, building blocks 106 including a building block 106*a*, a projectile launcher 108, projectiles 110 including projectile 110*a*, and primary target pieces 112 including primary target piece 112*a*. The skills game 102 may also include bonus target pieces 114 including bonus target piece 114*a*.

The deck of cards 104 may comprise a plurality of individual cards. Each card may provide at least one instruction, guide, or rule for continued game play. For example, each card may be printed with one or more illustrations, icons, or symbols.

The building blocks 106 may comprise a plurality of various-shaped blocks. Each block may be of a different shape or size from another block. In some embodiments, the building blocks 106 are stackable. In one embodiment, each block may be placed or balanced on top of at least one other block without immediately falling off.

The projectile launcher 108 is configured to launch the projectiles 110. The projectile launcher 108 may be capable of storing energy and then transferring the stored energy to the projectiles 110. For example, the projectile launcher 108 may be of a catapult configuration or of a trebuchet configuration or of a sling shot configuration or of some other similar configuration. The projectile launcher 108 may store energy in a spring, elastic or rubber band, etc. The projectiles 110 are objects launchable by the projectile launcher 108. The projectiles 110 may be objects of various sizes and shapes.

The primary target pieces 112 are objects that the projectiles 110 are intended to hit and otherwise to knock down or cause to fall down. The bonus target pieces 114 are additional objects that the projectiles 110 may hit and otherwise knock down or cause to fall down. The primary target pieces 112 and the bonus target pieces 114 may be substantially planar or may be three-dimensional. The primary target pieces 112 may share common characteristics that identify them as such, and the bonus target pieces 114 may share a different set of common characteristics that identify them as such.

One exemplary composition of the game kit 102 may include the following: fifty-six mission cards, one sling shot launcher, one small red spherical bird projectile, one small yellow conical bird projectile, one large spherical black bird projectile, four green pig-shaped targets, six long rectangular-shaped building blocks, four short rectangular-shaped building blocks, four cube-shaped building blocks, four wedge-shaped building blocks, and two bonus target pieces.

Figure 2:
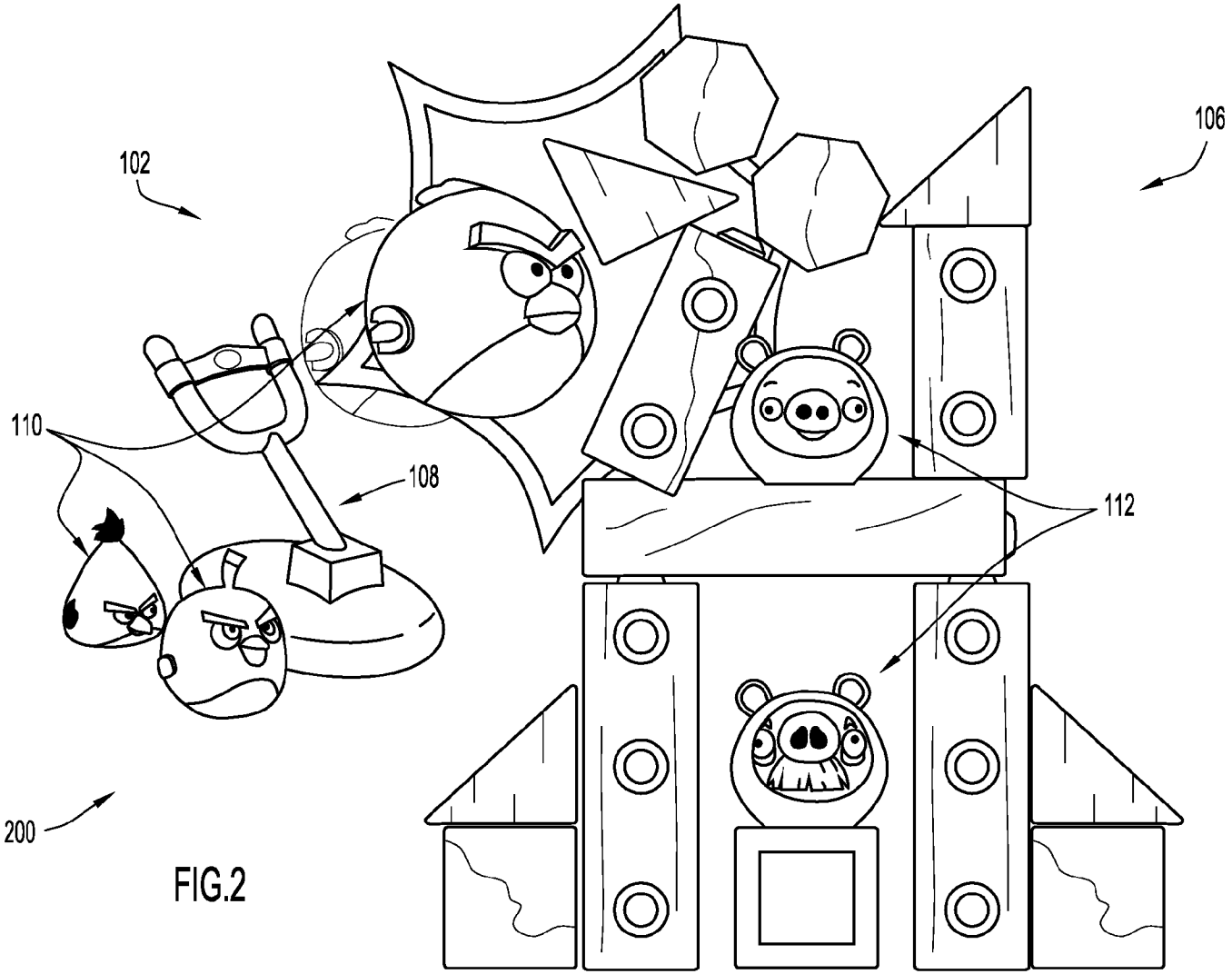
FIG. 2 is a drawing of an embodiment of a skills game kit.

FIG. 2 is drawing 200 of an embodiment of a skills game kit 102. The skills game kit 102 includes building blocks 106, a projectile launcher 108, projectiles 110, and primary target pieces 112. The building blocks 106 include rectangular-shaped blocks, octagonal-shaped blocks, triangular-shaped blocks, square-shaped blocks, and hollow square-shaped blocks. The various-shaped blocks are stacked into a structural formation. The primary target pieces 112 are placed at strategic locations within the structural formation. In this embodiment, the primary target pieces 112 are characters shaped as pigs with differing comical cartoon faces. The projectiles 110 are characters shaped as angry cartoon birds. Two of the birds are spherically-shaped, while a third is conically-shaped. Each are of a different color. One of the birds is shown colliding with the structural formation and knocking various building blocks 106 from the structural formation.

Figure 3:
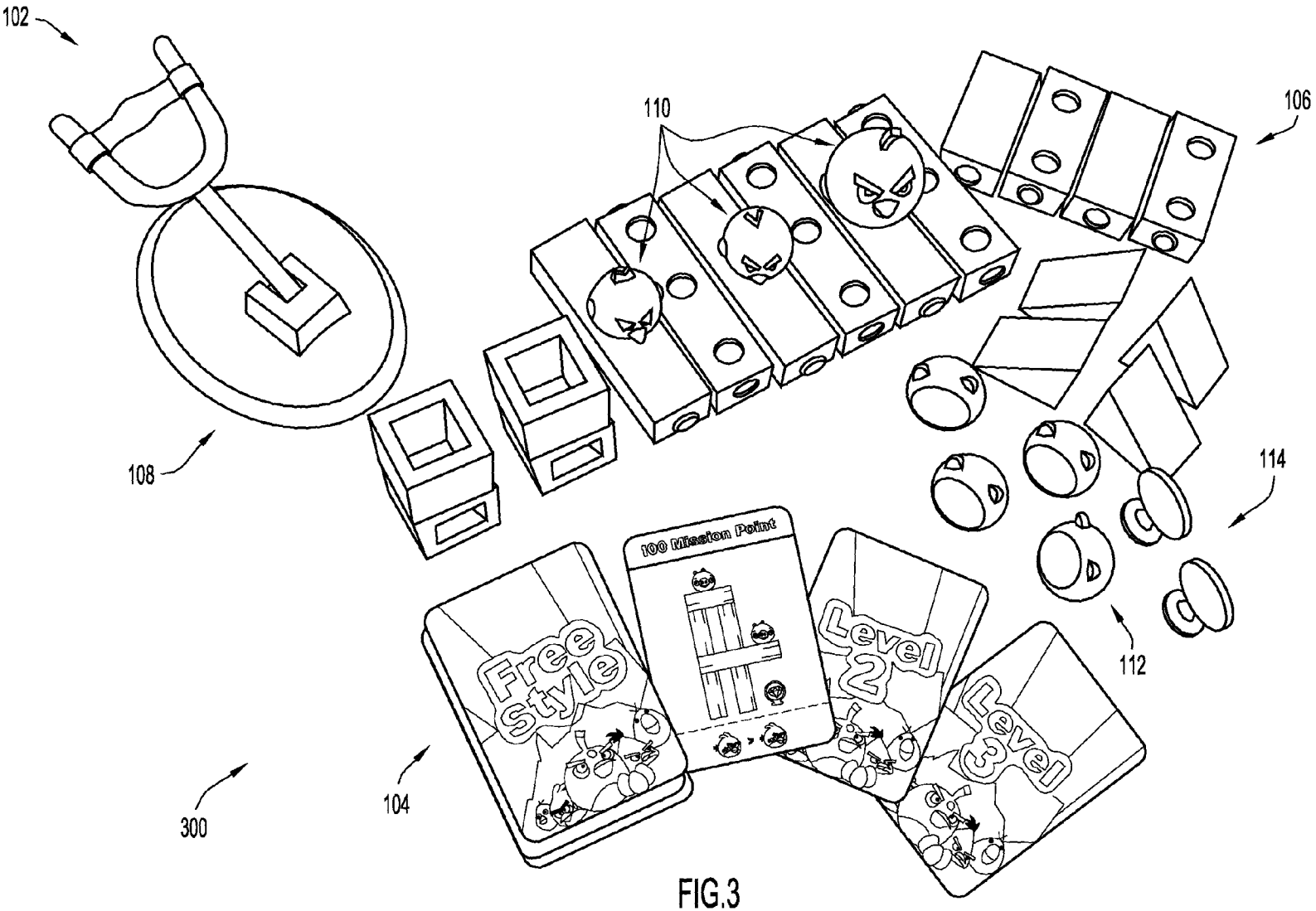
FIG. 3 is a front perspective view of an embodiment of a skills game kit.

FIG. 3 is a front perspective view 300 of an embodiment of a skills game kit 102. The skills game kit 102 includes a deck of cards 104, building blocks 106, a projectile launcher 108, projectiles 110, primary target pieces 112, and bonus target pieces 114. The deck of cards 104 includes graphical illustrations of different styles of game play for which the card may be associated. For example, a set of cards may be associated with a "freestyle" type of game play. Alternatively, a set of cards may be associated with various levels of difficulty for another style of game play, such as "level 1" or "level 2" or "level 3".

Some of the building blocks 106 have slight protrusions and slight recesses on their bodies. A protrusion on one block may loosely fit within a recess of another block to create a loose frictional fit between the two blocks. The protrusions and recesses may aid in joining or stacking the blocks to create a structural formation. The projectile launcher 108 is in the shape of a sling shot. However, the projectile launcher in this embodiment may operate as a spring-loaded catapult. A projectile may fit in the gap defined by each of the tines and the "elastic" band. The tines and the "elastic" band, in this case, may be constructed from a single piece of molded plastic. A spring, such as a torsion spring, at the base of the sling shot may pivot the entire sling shot and catapult the projectile toward a target from where it sits in the gap.

The projectiles 110 are of varying sizes. The projectiles 110 may be composed of different materials or of materials with different densities, such that the projectiles 110 each have a different mass or other physical property. For example, the projectiles 110 may have different surface textures. Different surface textures may aid in distinguishing the different projectiles and may provide different cushioning properties upon contact with a target. Two of the projectiles 110 are of generally spherical shapes, and a third of the projectiles 110 is of a generally gumdrop or conical shape. The projectiles 110 include features such as angry cartoon bird faces, tufts of feathers, and nubs for wings, which aid in distinguishing one projectile from another. The primary target pieces 112 are of the same color and each have a pair of protrusions on top that aid in characterizing each piece as a primary target. The bonus target pieces 114 are of a color different than the primary target pieces 112 and of a shape akin to a planar trophy or a round sign.

Figure 4:
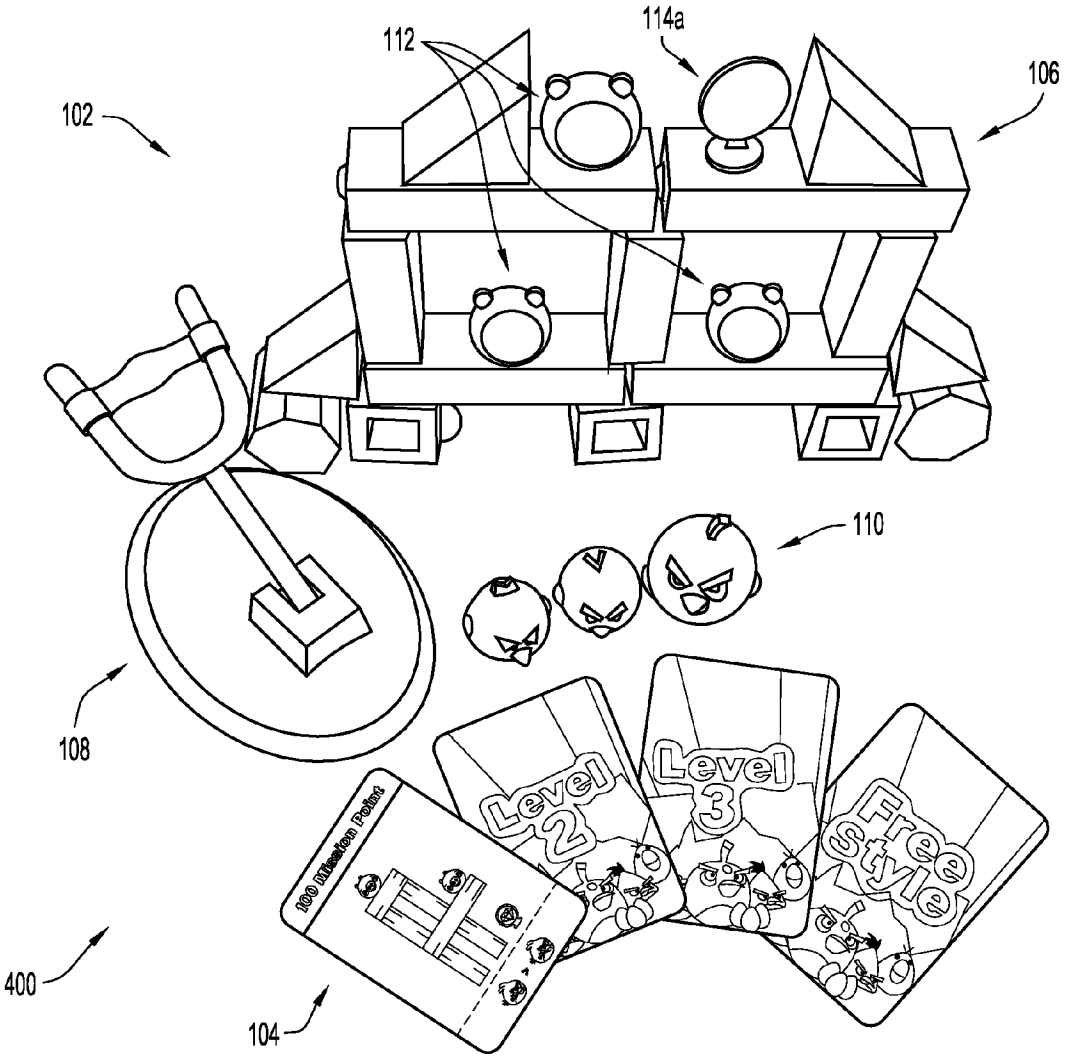
FIG. 4 is a front perspective view of another embodiment of a skills game kit.

FIG. 4 is a front perspective view 400 of another embodiment of a skills game kit 102. The skills game kit 102 includes a deck of cards 104, building blocks 106, a projectile launcher 108, projectiles 110, primary target pieces 112, and bonus target piece 114*a*. The building blocks 106 in this embodiment are loosely stacked and connected with each other to form a structural formation.

Figure 5:
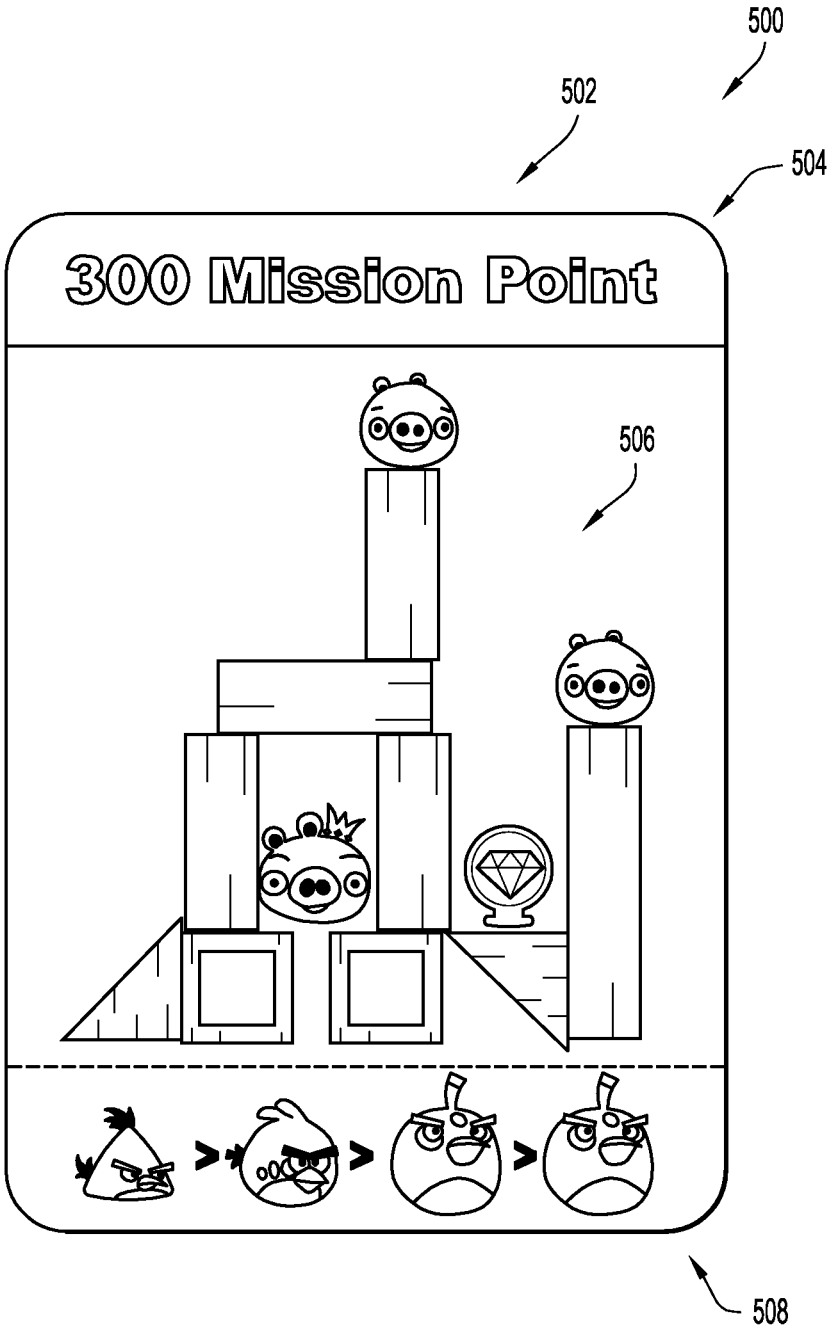
FIG. 5 is an illustration of an embodiment of a mission card.

FIG. 5 is an illustration 500 of an embodiment of a mission card 502. The mission card 502 includes a points section 504, a structural formation section 506, and a projectile order section 508. The points section 504 includes text or graphics illustrating a point value for the mission card 502. For example, the mission card 502 may be worth three hundred mission points. The structural formation section 506 includes an illustration of the building blocks 106 or a subset of the building blocks 106. The illustration may indicate the placement and alignment of the building blocks 106 to create a structural formation. The illustration may also indicate the placement of primary target pieces 112 and bonus target pieces 114 within the structural formation. Alternatively, the structural formation section 506 may include an illustration of a list of the building blocks 106, primary target pieces 112, and bonus target pieces 114 for building a structural formation without providing an explicit placement and alignment of the building blocks 106. Providing a list instead of an explicit structure may be associated with a "freestyle" type of game play and extend an opportunity for creative thinking and design.

The projectile order section 508 includes text or graphics illustrating a projectile order. The projectile order may be an order in which the projectiles 110 are to be launched from the projectile launcher 108 at primary target pieces 112 within the structural formation. The projectile order may be illustrated by characteristic features identifying the projectiles 110. In one instance where the characteristic features include relative size, color, and shape, the order may be illustrated as [(small yellow conical-shaped projectile), (small red spherical-shaped projectile), (large black spherical-shaped projectile), (large black spherical-shaped projectile)].

Figure 6:
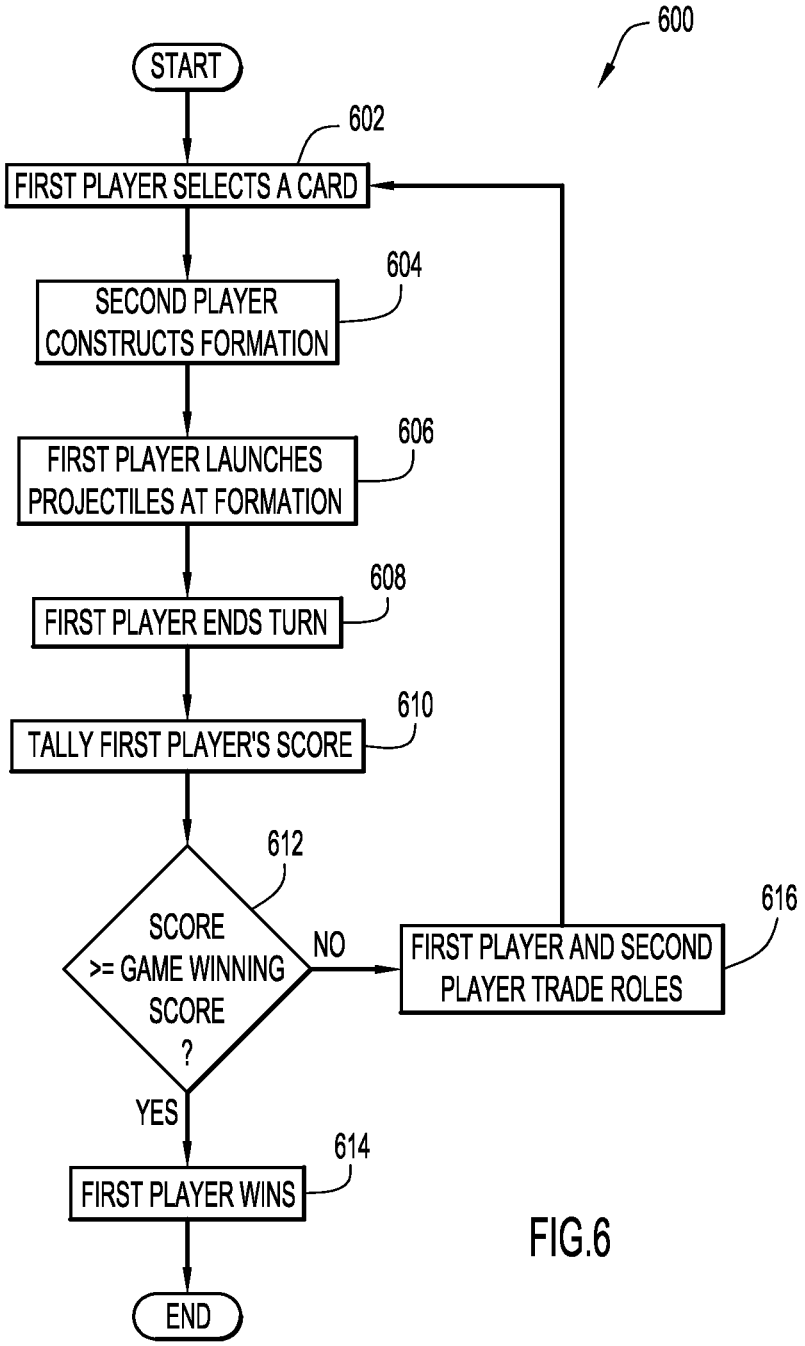
FIG. 6 is a flowchart of an exemplary game flow.

FIG. 6 is a flowchart 600 of an exemplary game flow. A first player randomly selects a card 104*a* from the deck of cards 104 (602). The selection may be made from one of different sets of cards, where each set of cards contains cards of a particular type of game play or associated with a particular level of difficulty. For example, the first player may select a card 104*a* from a "level 2" set or from a "freestyle" set. The selected card 104*a* may be a mission card 502 illustrating a mission for the first player to accomplish. The mission may be assigned a point value for its successful completion. The point value may be illustrated on the selected card 104*a*. The selected card 104*a* may illustrate a structural formation and a projectile order. Alternatively, the selected card 104*a* may illustrate a list of building blocks 106.

In one embodiment, the set from which the player selects a card 104*a* depends on the level of advancement within a ladder-style play pattern. For example, the object of the game may be for a player to complete a set of missions from each of the various levels in a particular order. So, for a player to win, they must first complete missions from the "level one" deck, then missions from the "level two" deck, then the "level three" deck, and finally from the "freestyle" deck.

A second player constructs a structural formation based on the selected card 104*a* (604). The player may construct the structural formation from the building blocks 106. The constructed structural formation may correspond to an illustrated structural formation on the selected card 104*a*. The constructed structural formation may include the primary target pieces 112 and the bonus target pieces 114. Alternatively, the structural formation may be constructed from building blocks 106 on a list illustrated on the selected card 104*a*.

The first player attempts to launch the projectiles 110 at primary target pieces 112 within the constructed structural formation (606). The player may load the projectiles 110 one at a time in the projectile launcher 108 and use stored energy in the projectile launcher 108 to launch the projectiles 110. The projectile launcher 108 may be located a pre-selected distance from the constructed structural formation. The projectile launcher 108 may be placed relative to the front of the constructed structural formation. Alternatively, the projectile launcher 108 may be placed relative to one side of the constructed structural formation. The player may launch the projectiles 110 according to an illustrated projectile order on the selected card 104*a*.

The first player then ends their turn (608). The player's turn may end when they have exhausted a given supply of the projectiles 110. Alternatively, the player's turn may end when they have successfully launched the projectiles 110 to knock the primary target pieces 112 from the structural formation. Upon completion of the turn, the first player's score is tallied (610). Tallying the score may include adding a mission point value when all the primary target pieces 112 have been knocked off the structural formation. A bonus point value may be added to the score if the primary target pieces 112 have all been knocked off with fewer than the allotted number of projectiles 110. Tallying the score may also include adding a bonus point value when one of the bonus target pieces 114 has been knocked off the structural formation. The first player's score for the turn may be added to an aggregate score.

The first player's score may then be compared to a game winning score (612). If the first player's score compares favorably to the game winning score, then the first player wins (614). If the first player's score does not compare favorably to the game winning score, then the first player and the second player trade roles (616). The second player may perform the above steps in the role of the first player, and vice versa. The second player is then provided the opportunity to add to their score by following the same process as the first player.

Alternatively, if the first player's score compares favorably to the game winning score, the first player may then be promoted to a higher level of play. For example, the first player may be promoted from selecting cards from the "level one" deck to selecting cards from the "level two" deck. Game play then may continue until the first player has successfully completed missions from each of the various decks.

Figure 7:
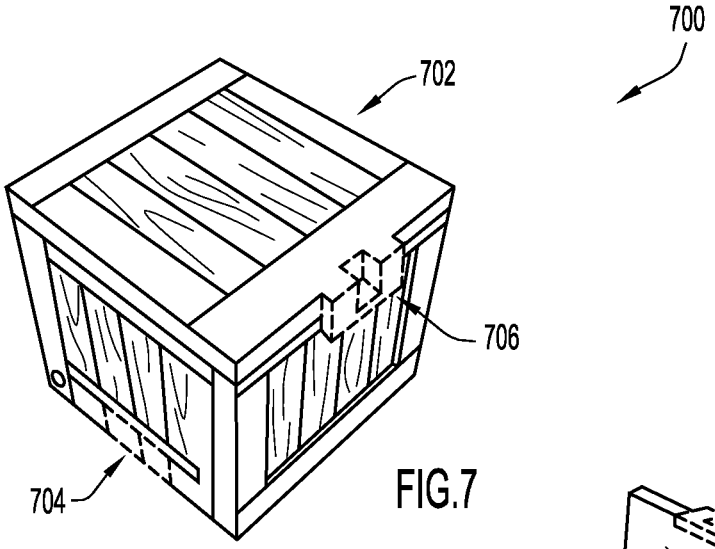
FIG. 7 is a perspective view of an expanding construct in a contracted configuration.

FIG. 7 is a perspective view 700 of an expanding construct 702 in a contracted configuration according to some embodiments of the present invention. The illustrated expanding construct 702 is a cube with aesthetic details rendering it similar to a wooden crate. The expanding construct 702 includes one or more hinges 704. Each hinge connects one side of the construct to an adjacent side. Each hinge may include a torsion spring that stores energy while the construct is in the contracted configuration. The expanding construct 702 is held in the contracted configuration by a latch 706. The latch 706 may hold one side of the construct in contact with an adjacent side by a loose friction fit. The loose friction fit may allow some minimal transfer of energy, such as jostling of the construct, to release the contact with the adjacent side.

Figure 8:
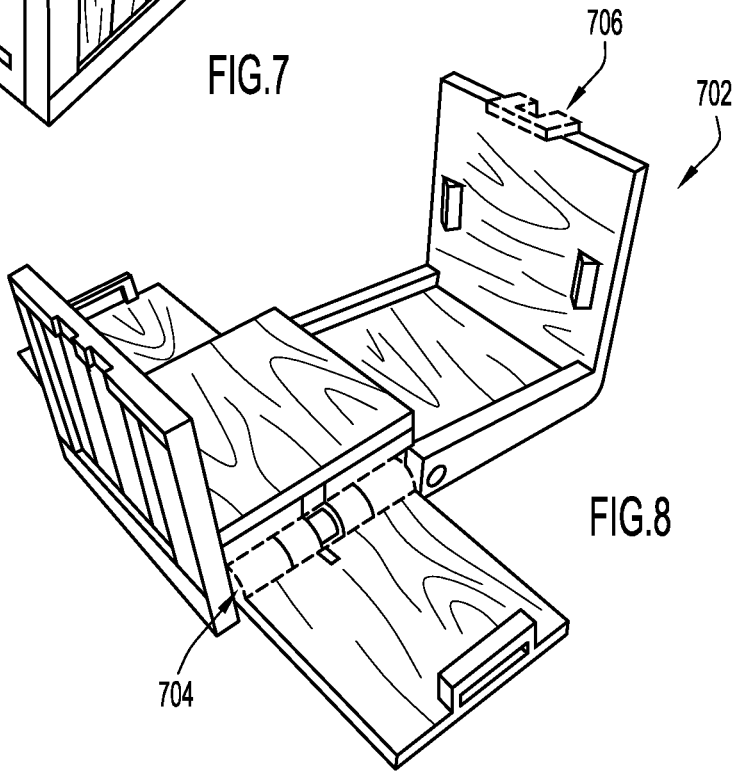
FIG. 8 is a perspective view of the expanding construct in an expanded configuration.

FIG. 8 is a perspective view 800 of the expanding construct 702 in an expanded configuration according to some embodiments of the present invention. The hinges 704 may be biased towards the open position, for example with a torsion spring, such that when the latch 706 releases contact with its adjacent side, all the sides with biased hinges expand outward from the contracted configuration. The expanding construct 702 may be reconfigured back to a contracted configuration by moving the sides back to their contracted positions and re-establishing the loose friction fit of the latch with its adjacent side.

Figure 9:
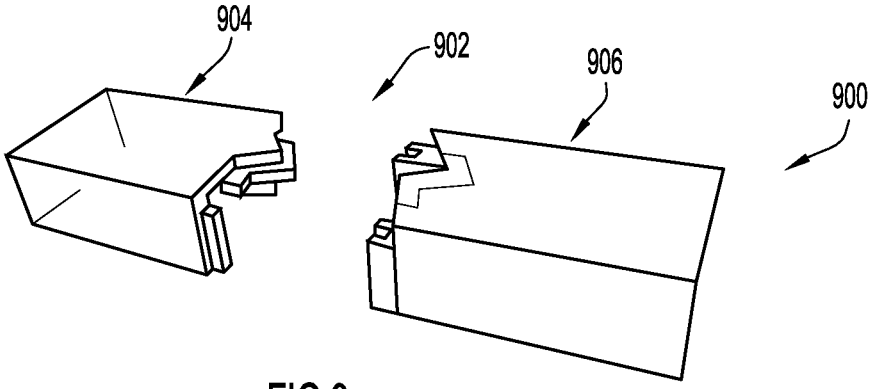
FIG. 9 is a perspective view of a separable construct in a separated configuration.

FIG. 9 is a perspective view 900 of a separable construct 902 in a separated configuration according to some embodiments of the present invention. The separable construct 902 includes a left component 904 and a right component 906. The left component 904 and the right component 906 are configured to be held together, in this example by a loose frictional fit. When the left component 904 and the right component 906 are held together, the separable construct 902 may bear some weight, but the loose friction fit may allow some minimal transfer of energy, such as jostling of the construct, to release the contact between the two components.

The expanding construct 702 and/or the separating construct 902 may be included in a game kit, such as a skills game kit. The construct(s) may be illustrated on one or more cards in the game kit, such as a mission card. The illustration may indicate the placement and alignment of the construct(s) in relation to one or more building blocks, expanding constructs, primary target pieces, and/or bonus pieces within a structural formation. Alternatively, the illustration may be part of a list for building a structural formation without an explicit placement and alignment within the structural formation. Inclusion of an expanding construct 702 or a separating construct 903 in a game kit with a structural formation may add a variable dynamic to the game play. The added degree of movement, such as the sudden expansion or separation of the construct, adds an additional consideration for strategy.

Exemplary descriptions of the present invention include the following:

A game kit comprising: a plurality of building blocks; a primary target piece adapted for placement about the plurality of building blocks; a card including an illustration of the plurality of building blocks and the primary target piece; a projectile; and a projectile launcher adapted to launch the projectile at the primary target piece.

The game kit above further comprising a bonus target piece adapted for placement about the plurality of building blocks.

The game kit above further comprising an expanding construct.

The game kit above further comprising a separating construct.

The game kit above, where the primary target piece is one of a plurality of primary target pieces, each primary target piece adapted for placement about the plurality of building blocks.

The game kit above, where the plurality of primary target pieces are of a similar size and shape.

The game kit above, where the plurality of building blocks include different sizes and shapes of building block.

The game kit above, where the projectile is one of a plurality of projectiles, each projectile adapted for launching by the projectile launcher.

The game kit above, where the plurality of projectiles include different sizes and shapes of projectile.

The game kit above, where the card is one of a plurality of cards, each card including an illustration of the primary target piece and at least a subset of the plurality of building blocks.

The game kit above, where the projectile launcher is a spring-loaded catapult-style launcher.

A method of game play with components of a game kit, the method comprising: selecting a card, the card including illustrations of a plurality of building blocks and a primary target piece; constructing a structural formation from the plurality of building blocks and the primary target piece; and launching a projectile from a projectile launcher at the primary target piece within the structural formation.

The method of game play above further comprising tallying a score based on an outcome of launching the projectile at the structural formation.

The method of game play, where the card further includes an illustration of a bonus target piece, and where constructing a structural formation further includes constructing the structural formation from the plurality of building blocks, the primary target piece, and the bonus target piece.

The method of game play above, where the card further includes illustrations of a predetermined arrangement of the plurality of building blocks and primary target piece, and where constructing a structural formation further includes constructing the structural formation into the predetermined arrangement from the plurality of building blocks and the primary target piece.

The method of game play above, where the card further includes illustrations of a list of the plurality of building blocks and primary target piece without a predetermined arrangement.

The method of game play above, where launching the projectile further includes launching a plurality of projectiles from the projectile launcher at the primary target piece within structural formation.

The method of game play above, where the card further includes illustrations of a predetermined order of the projectiles, and where launching the plurality of projectiles further includes launching the plurality of projectiles from the projectile launcher at the primary target piece within the structural formation in the predetermined order.

It is believed that the disclosure set forth above encompasses multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any description recites "a" or "a first" element or the equivalent thereof, such disclosure should be understood to include incorporation of one or more such elements, neither requiring nor excluding two or more such elements.

While various embodiments of the skills game have been described, it will be apparent to those of ordinary skill in the art that many more embodiments and implementations are possible within the scope of the invention. Thus, it is intended that the present invention covers modifications and variations of this invention provided they come within the scope of the appended claims and their equivalents. For example, the majority of the elements can be formed of molded plastic. However, in alternative embodiments, the elements can be formed of a material other than plastic provided that the material has sufficient strength for the component's intended function.

What is claimed is:

1. A game kit, comprising:

a plurality of building blocks;

a primary target piece adapted for placement about the plurality of building blocks;

a card including an illustration of the plurality of building blocks and the primary target piece;

a projectile; and a projectile launcher adapted to launch the projectile at the primary target piece.

2. The game kit of claim 1, further comprising:

a bonus target piece adapted for placement about the plurality of building blocks.

3. The game kit of claim 1, further comprising:

an expanding construct.

4. The game kit of claim 1, further comprising:

a separating construct.

5. The game kit of claim 1, wherein the primary target piece is one of a plurality of primary target pieces, and each primary target piece is adapted for placement about the plurality of building blocks.

6. The game kit of claim 5, wherein the plurality of primary target pieces are of a similar size and shape.

7. The game kit of claim 1, wherein the plurality of building blocks include different sizes and shapes of building blocks.

8. The game kit of claim 1, wherein the projectile is one of a plurality of projectiles, and each projectile is adapted for launching by the projectile launcher.

9. The game kit of claim 8, wherein the plurality of projectiles include different sizes and shapes of projectiles.

10. The game kit of claim 1, wherein the card is one of a plurality of cards, and each card includes an illustration of the primary target piece and at least a subset of the plurality of building blocks.

11. The game kit of claim 1, wherein the projectile launcher is a spring-loaded catapult-style launcher.

12. A method of game play with components of a game kit, the method comprising:

selecting a card, the card including illustrations of a plurality of building blocks and a primary target piece;

constructing a structural formation from the plurality of building blocks and the primary target piece; and launching a projectile from a projectile launcher at the primary target piece within the structural formation.

13. The method of claim 12, further comprising:

tallying a score based on an outcome of launching the projectile at the structural formation.

14. The method of claim 12, wherein the card further includes an illustration of a bonus target piece, and constructing a structural formation further includes constructing the structural formation from the plurality of building blocks, the primary target piece, and the bonus target piece.

15. The method of claim 12, wherein the card further includes illustrations of a predetermined arrangement of the plurality of building blocks and primary target piece, and constructing a structural formation further includes constructing the structural formation into the predetermined arrangement from the plurality of building blocks and the primary target piece.

16. The method of claim 12, wherein the card further includes illustrations of a list of the plurality of building blocks and primary target piece without a predetermined arrangement.

17. The method of claim 12, wherein launching the projectile further includes launching a plurality of projectiles from the projectile launcher at the primary target piece within structural formation.

18. The method of claim 12, wherein the card further includes illustrations of a predetermined order of the projectiles, and launching the plurality of projectiles further includes launching the plurality of projectiles from the projectile launcher at the primary target piece within the structural formation in the predetermined order.

19. A method of game play, comprising:

selecting a card, the card including illustrations of a plurality of building blocks and a primary target piece;

constructing a structural formation from the plurality of building blocks and the primary target piece; and launching a projectile at the primary target piece and the structural formation.

20. The method of claim 19, wherein the illustrations of the plurality of building blocks and the primary target piece is a predetermined arrangement, and constructing a structural formation includes forming the predetermined arrangement using the plurality of building blocks and the primary target piece.

* * * * *